US008342583B2

(12) United States Patent
Stauffer et al.

(10) Patent No.: US 8,342,583 B2
(45) Date of Patent: Jan. 1, 2013

(54) VEHICLE PANEL CONTROL SYSTEM

(75) Inventors: Louise E. Stauffer, Bloomfield Hills, MI (US); Timothy Saunders, Warren, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 375 days.

(21) Appl. No.: 12/626,985

(22) Filed: Nov. 30, 2009

(65) Prior Publication Data

US 2010/0192648 A1 Aug. 5, 2010

Related U.S. Application Data

(60) Provisional application No. 61/148,649, filed on Jan. 30, 2009.

(51) Int. Cl.
*E05B 3/00* (2006.01)
*E05C 19/00* (2006.01)

(52) U.S. Cl. ..... 292/336.3; 292/1

(58) Field of Classification Search ..... 292/336.3, 292/1
See application file for complete search history.

(56) References Cited

U.S. PATENT DOCUMENTS

| | | | | |
|---|---|---|---|---|
| 4,778,206 | A * | 10/1988 | Matsumoto et al. | 292/201 |
| 6,072,403 | A * | 6/2000 | Iwasaki et al. | 340/5.72 |
| 6,698,262 | B2 * | 3/2004 | Wittwer | 70/208 |
| 7,005,959 | B2 * | 2/2006 | Amagasa et al. | 340/5.3 |
| 7,866,714 | B2 * | 1/2011 | Monig et al. | 292/336.3 |
| 2001/0005082 | A1 * | 6/2001 | Suparschi | 292/347 |

* cited by examiner

*Primary Examiner* — Carlos Lugo
(74) *Attorney, Agent, or Firm* — Quinn Law Group PLLC

(57) ABSTRACT

A vehicle panel control system includes a vehicle panel and a handle pivotably connected to the vehicle panel. The handle is movable about a pivot point in a first direction to unlatch or move the panel. A switch is positioned to be closed when the handle is sufficiently moved in a second direction opposite the first direction, closure of the switch is operable to unlatch or move the panel. Thus, the unlatching or movement of the panel is accomplished by either of two different motions.

11 Claims, 6 Drawing Sheets

VEHICLE PANEL CONTROL SYSTEM

CROSS-REFERENCE TO RELATED APPLICATIONS

This application claims the benefit of U.S. Provisional Patent Application No. 61/148,649, filed Jan. 30, 2009, which is hereby incorporated by reference in its entirety.

TECHNICAL FIELD

The invention relates to a panel control system for a vehicle.

BACKGROUND OF THE INVENTION

Automotive vehicles are becoming more customizable in order to meet the values and priorities of customers. Additionally, customers generally desire flexibility to reconfigure or to access various features of a vehicle to meet their specific needs. Ease of use of vehicle components is an important factor in customer satisfaction.

SUMMARY OF THE INVENTION

A vehicle panel control system is configured to provide fingertip control of movement or unlatching of a vehicle panel by utilizing over-travel of a mechanical handle. The control system provides low clutter execution of a moving panel control switch for a moving panel system.

Specifically, a vehicle panel control system includes a vehicle panel and a handle pivotably connected to the vehicle panel. The handle is movable about a pivot point in a first direction to unlatch or move the panel. A switch is positioned to be closed when the handle is sufficiently moved in a second direction opposite the first direction, closure of the switch is operable to unlatch or move the panel. Thus, the unlatching or movement of the panel is accomplished by either of two different motions.

In some embodiments, moving the handle in the first direction is by pulling the handle which mechanically unlatches or moves the panel. In another embodiment, moving the handle in the first direction also closes the switch; thus, the switch causes the unlatching or moving of the panel by motion of the handle in either direction.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
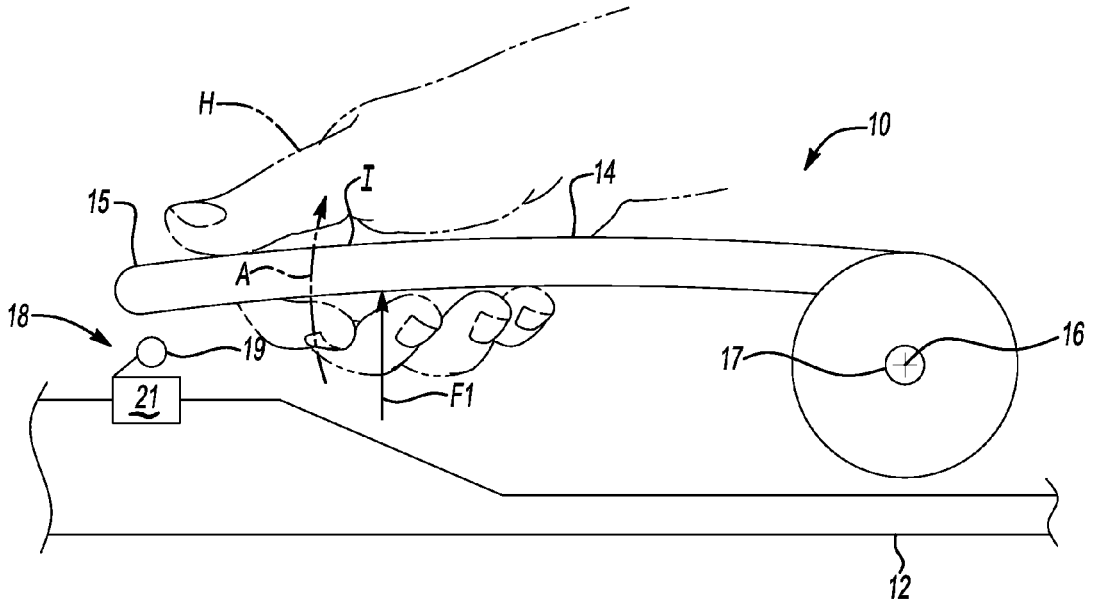
FIG. 1 is a schematic fragmentary top view of a first embodiment of a vehicle panel control system including a handle in a neutral position and a switch in an open position, with a hand shown in phantom.

Referring to the drawings, wherein like reference numbers refer to like components throughout the several views, FIGS. 1-8 show various embodiments of vehicle panel control systems.

FIG. 1 shows a vehicle panel control system 10 that is configured to provide fingertip control of movement or unlatching of a vehicle panel 12 by utilizing over-travel of a mechanical handle 14. As used herein, "over-travel" is motion permitted in an opposing direction than that for which the handle 14 is designed for accomplishing its primary function of moving or unlatching vehicle panel 12. The panel 12 is represented as a trim panel handle molding of a vehicle door. The handle 14 is pivotably connected to the panel 12 to pivot about an axis through pivot point 16. The connection of the handle 14 to the panel 12 is via a rod 17 running through the opening in the handle connects to a portion of the panel 12 not shown for clarity in FIG. 1, but as is well understood by those skilled in the art. The handle 14 may be connected to the panel 12 by any known means that allow the handle 14 to pivot at pivot point 16.

Figure 8:
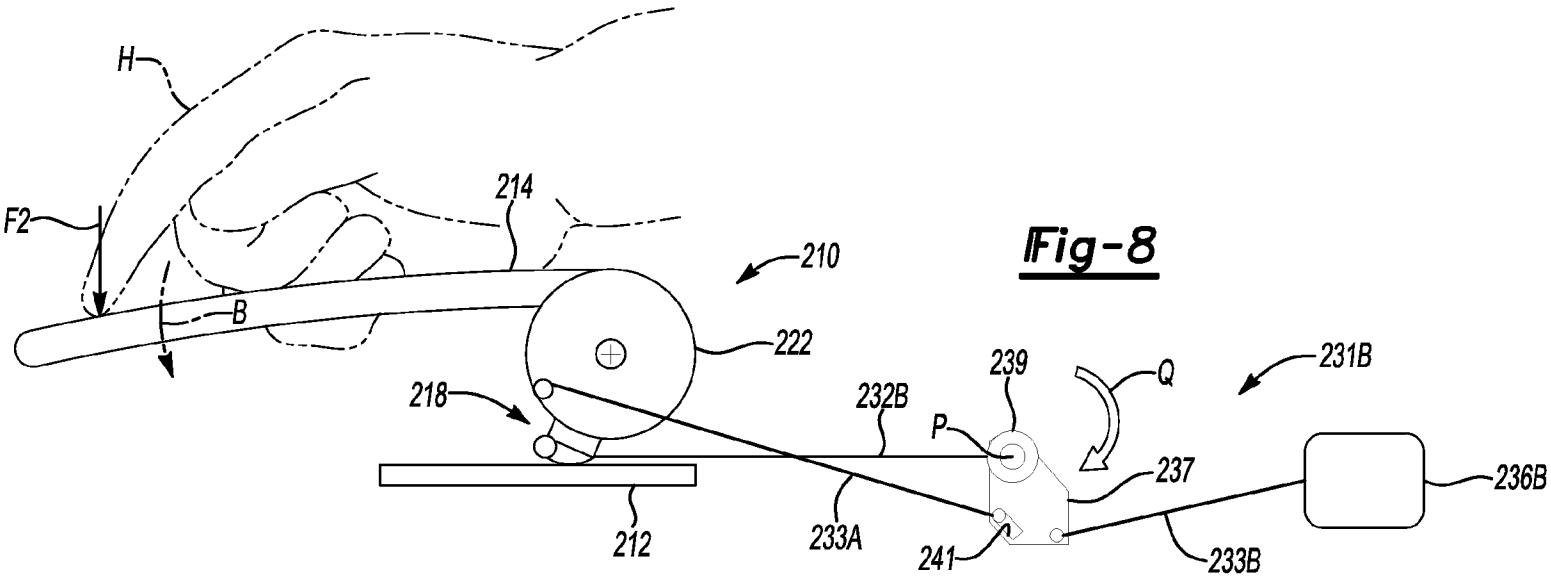
FIG. 8 is a schematic top view illustration of the vehicle panel control system of FIGS. 5 and 6 used in a mechanical latch system.

The handle 14 is a traditional leverage pull handle, and is shown in a neutral position in FIG. 1. The handle 14 is operable to open the panel 12 by pulling the handle 14 with force F1 applied to an inner side I of the handle 14 closest to the panel 12, to cause pivoting in the direction of rotation indicated by arrow A. In order to pull handle 14, a hand H would be positioned with a grip as shown, with much of the hand H in a space or cavity between the handle 14 and the panel 12. This causes the handle 14 to pull a cable which unlatches a latch connecting the door (of which the panel 12 is a part), to a vehicle frame, as is known. Alternatively, pulling the handle 14 in direction A may be designed to cause power movement of the panel 12 or of another vehicle panel. A representative mechanical latch 236B is shown in FIG. 8 and may be used with any of the handles shown herein.

A switch 18 is mounted to the panel 12 near the lever end 15 of the handle 14. Although shown extending slightly outward from the panel 12, the switch 18 is preferably integrated into the panel 12. The switch 18 may be activated to cause power movement or electronic lock release (unlatching) of the panel 12 in an alternative mode than the mechanical unlatching or movement accomplished by pulling the handle 14 as described with respect to FIG. 1. When the switch 18 is open, it is not operable to unlatch or move the panel 12; when closed, it unlatches or moves the panel 12. The switch 18 is open when contact element 19 is not in contact with switch body 21. The switch 18 is normally open when the handle 14 is in the neutral position shown in FIG. 1. When the handle 14 is pulled in direction A, the switch 18 remains open.

Figure 2:
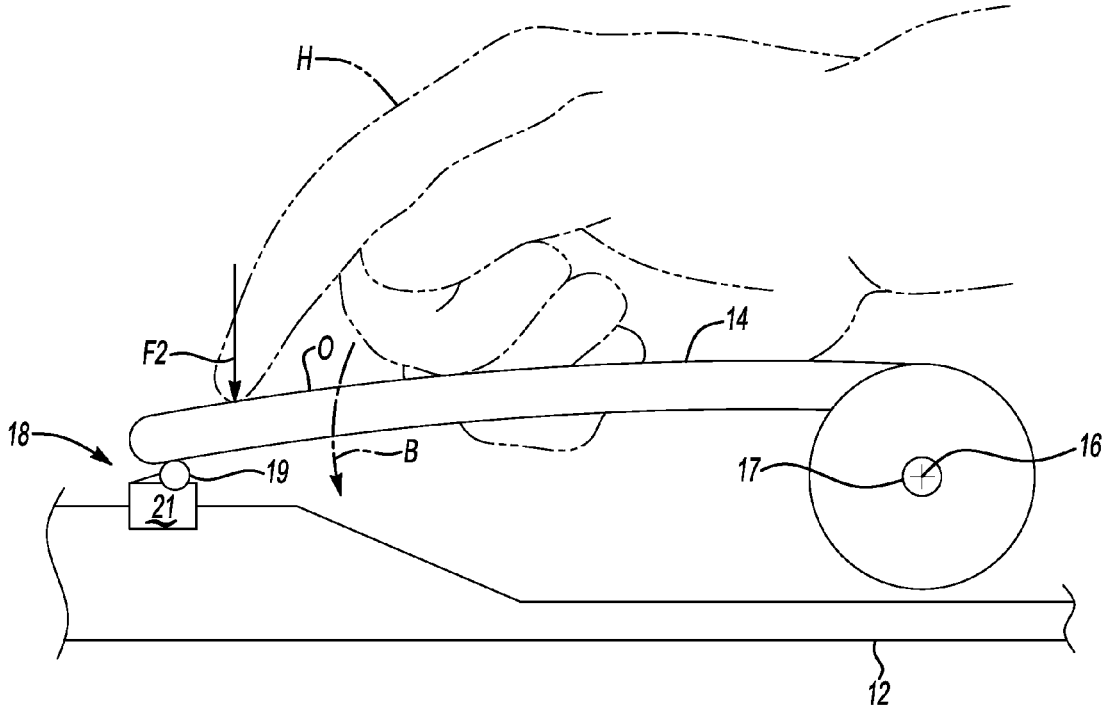
FIG. 2 is a schematic fragmentary top view of the vehicle panel control system of FIG. 1, with the handle pivoted in a second direction by the hand shown in phantom so that the switch is in a closed position.

Referring to FIG. 2, the handle 14 is shown moved in an opposing direction indicated by arrow B by a hand H applying force F2 to outer side O of the handle 14 to cause pivoting of the handle 14 about pivot point 16. The handle 14 is designed to permit such over-travel from the neutral position of FIG. 1. When pivoted in direction B, the switch 18 is tripped, i.e., closed. The switch 18 is closed when contact element 19 contacts switch body 21. Thus, the same function accomplished by pulling the handle 14 with force F1 (either unlatching or moving the panel 12 or another vehicle panel) is accomplished by pushing with force F2. The amount of travel necessary to activate the switch 18 is relatively small. Additionally, applying force F2 does not require placing fingers between the handle 14 and the panel 12, as is required to apply force F1. Thus, the switch 18 may be activated with low force and low contact. This may be beneficial for operators with impaired coordination or strength, those having recently manicured nails, those wearing thick gloves, etc. The same handle 14 is used in either mode, and the location of handle 14 is a traditional location, thus mitigating confusion and promoting ease of assembly.

Figure 3:
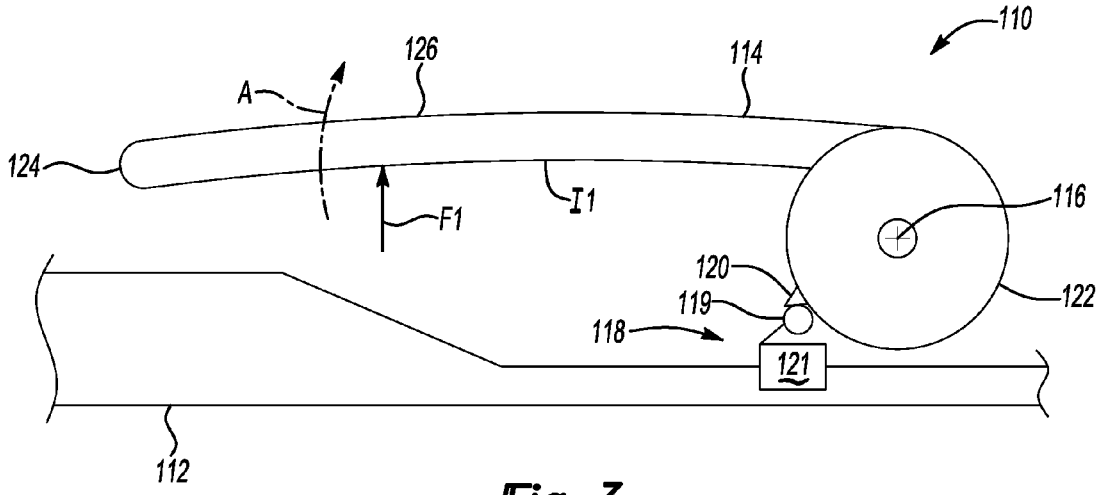
FIG. 3 is a schematic fragmentary top view of a second embodiment of a vehicle panel control system including a handle in a neutral position and a switch in an open position.
Figure 4:
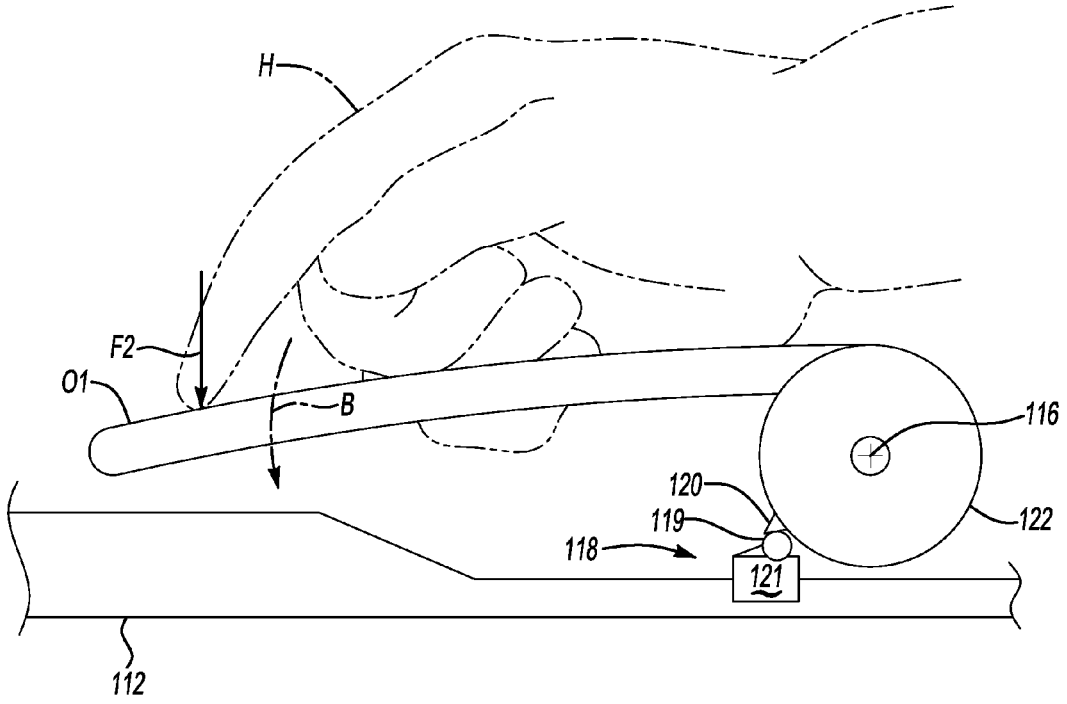
FIG. 4 is a schematic fragmentary top view of the vehicle panel control system of FIG. 3, with the handle pivoted in a second direction by the hand shown in phantom so that the switch is in a closed position.
Figure 10:
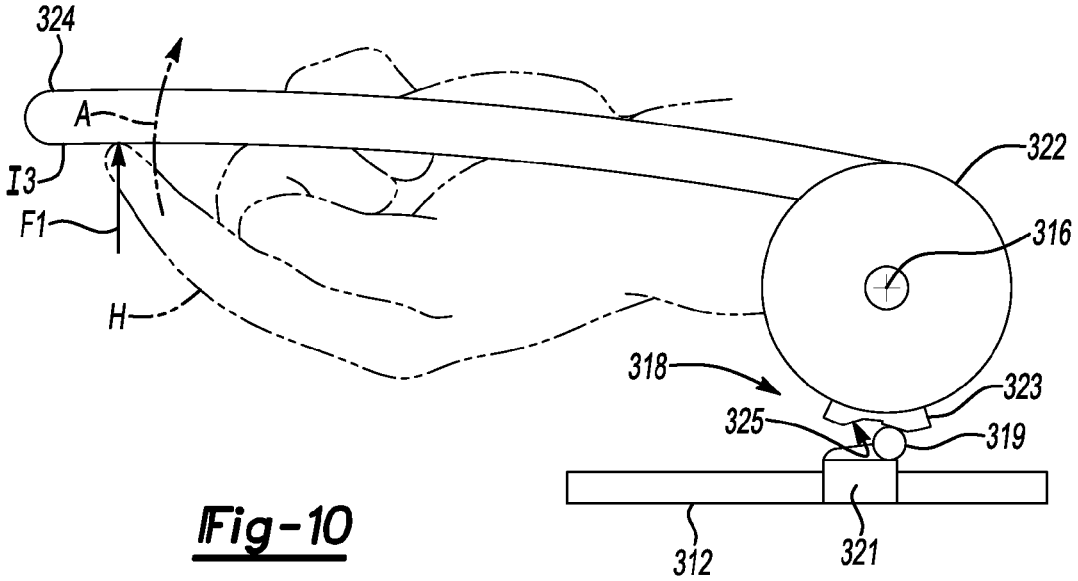
FIG. 10 is a schematic top view of the vehicle panel control system of FIG. 9, with the handle pivoted in a first direction by the hand shown in phantom so that the switch is in a closed position.

Referring to FIGS. 3 and 4, an alternate embodiment of a vehicle panel control system 110 is shown that utilizes a panel-mounted switch 118 near the pivot end of a handle 114. In this alternate construction, a door handle 114 is pivotable about pivot point 116 in direction of arrow A by applying force F1 to cause power movement or unlatching of the door of which trim panel 112 is a part, or of another panel. The force F1 is applied by positioning hand H as shown in FIG. 10, on the inner side I of the handle 124.

A switch 118 is mounted to the panel 112 relatively near the pivot axis 116 of handle 114, rather than near the end 124 of lever 126. The switch 118 is open when the handle 114 is in the neutral position shown in FIG. 3, and remains open when the handle 114 is manually pulled in the direction A. When the switch 118 is open, contact element 119 is not in contact with switch body 121, and the switch 118 is not operable to move or unlatch the panel 112 or another panel. When the switch 118 is closed, it causes unlatching or movement of the panel 112.

Referring to FIG. 4, when the handle 114 is moved in direction of rotation B by applying force F2 to outer side O1 of the handle 114, utilizing available over-travel motion, an extension 120 from the pivot body 122 of the handle 114 interferes with the switch 118 to activate (close) the switch 118 (i.e., placing contact element 119 in contact with switch body 121), causing power movement of the panel 112 or of another panel or electronic lock release (unlatching) of the panel 112.

Figure 5:
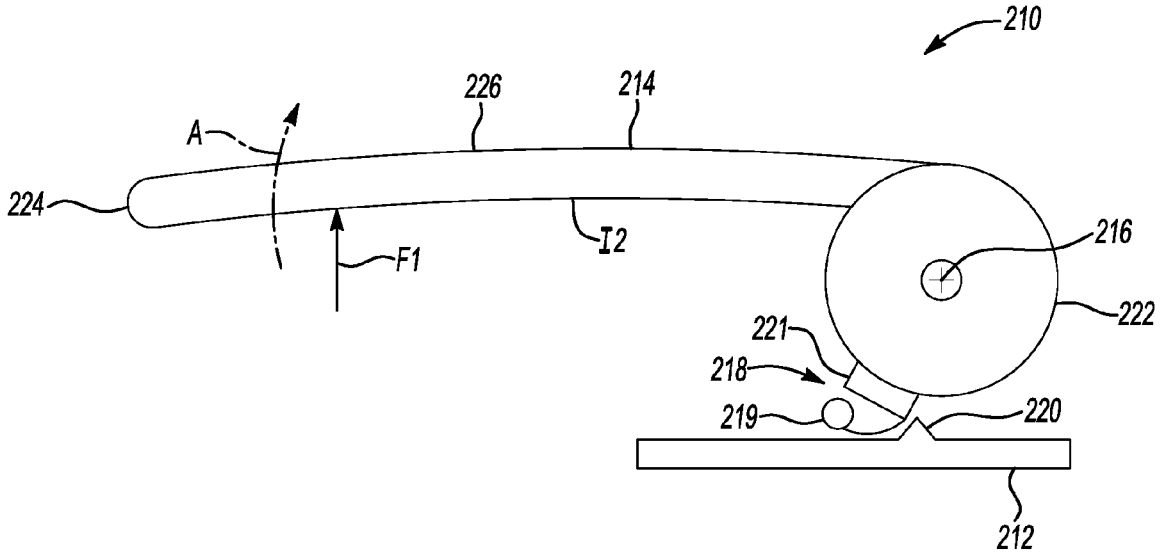
FIG. 5 is a schematic fragmentary top view of a third embodiment of a vehicle panel control system including a handle in a neutral position and a switch in an open position.
Figure 6:
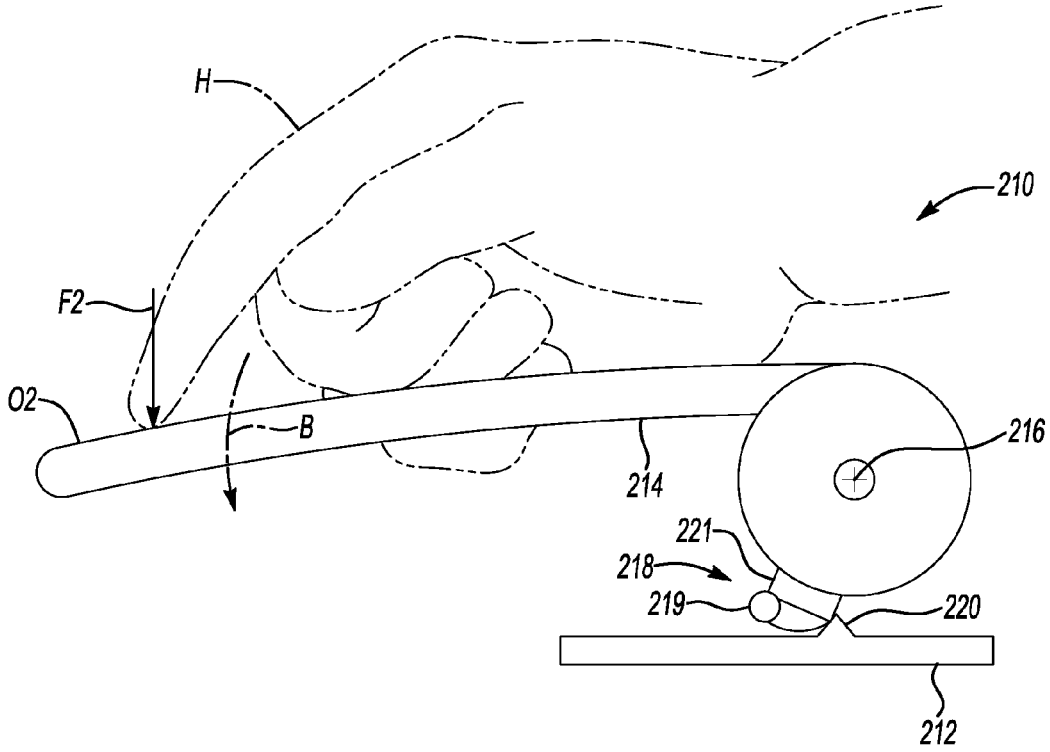
FIG. 6 is a schematic top view of the vehicle panel control system of FIG. 5, with the handle pivoted in a second direction by the hand shown in phantom so that the switch is in a closed position.

Referring to FIGS. 5 and 6, an alternate embodiment of a vehicle panel control system 210 is shown that utilizes a handle-mounted switch 218. In this alternate construction, a door handle 214 is pivotable about pivot point 216 in direction of arrow A by applying force F1 to inner side I2 of handle 214 to cause power movement or unlatching of the door to which trim panel 212 is a part or to cause power movement of another panel. A switch 218 is mounted to the pivot body 222 of the handle 214, relatively near the pivot axis 216 of handle 214, rather than near the end 224 of lever 226. The switch 218 is open when the handle 214 is in the neutral position shown in FIG. 5, and when the handle is manually pulled in the direction A. When the switch 218 is open, contact element 219 is not in contact with switch body 221, and the switch 218 is not operable to move or unlatch the panel 212 or another panel. When the switch 218 is closed, it causes unlatching or movement of the panel 212.

Referring to FIG. 6, when the handle 214 is moved in direction of rotation B by applying force F2 to outer side O2 of handle 214, utilizing available over-travel motion, an extension 220 from the trim panel 212 interferes with the switch 218 to activate (close) the switch 218 (i.e., placing contact element 219 in contact with switch body 221), causing power movement of panel 212 or of another panel or electronic lock release (unlatching) of the panel 212.

Figure 7A:
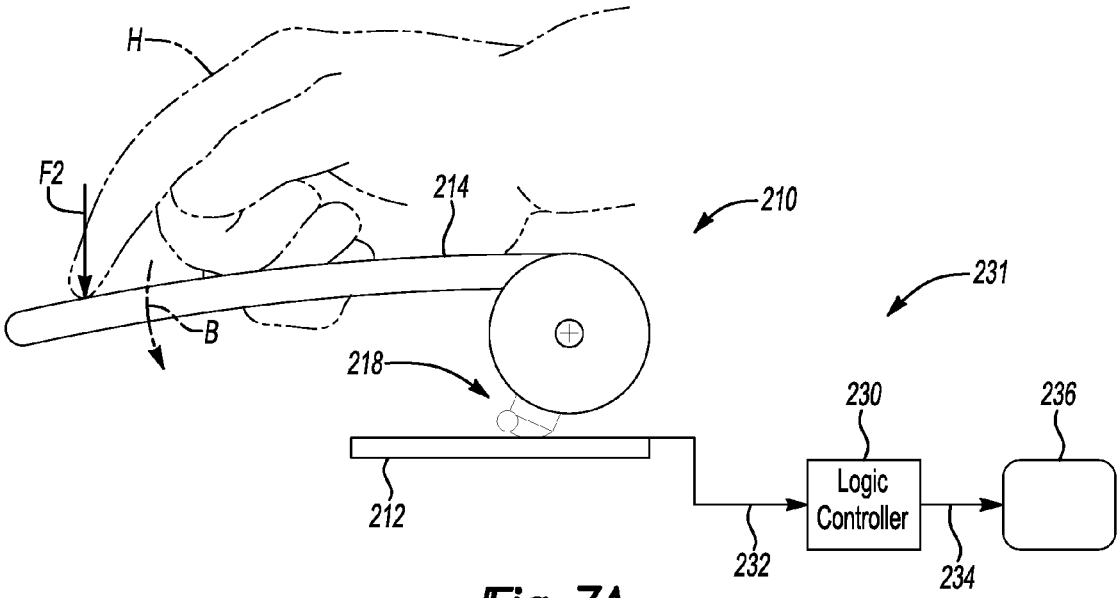
FIG. 7A is a schematic top view of the vehicle panel control system of FIGS. 5 and 6 used in a power door system.

Referring to FIG. 7A, the vehicle panel control system 210 of FIGS. 5 and 6 is shown as part of a power door system 231 that includes a controller 230 operable to receive a signal 232 from the activated switch 218, and to send a signal 234 to a power latch mechanism 236 in response to signal 232 to unlatch the door latch.

Figure 7B:
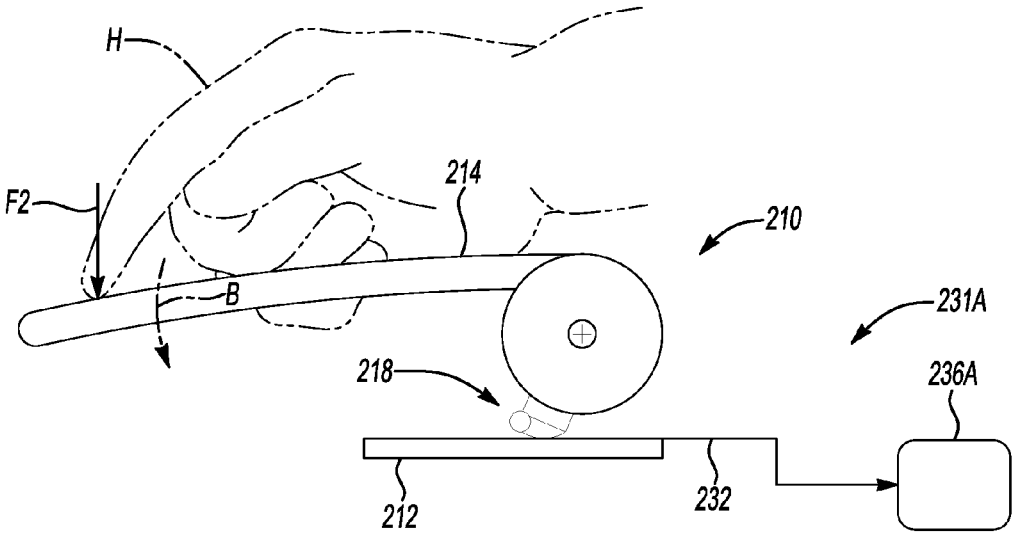
FIG. 7B is a schematic top view illustration of the vehicle panel control system of FIGS. 5 and 6 used in a power latch system.

Referring to FIG. 7B, the vehicle panel control system 210 of FIGS. 5 and 6 is shown as part of a power latch/manual door system 231A. In system 231A, signal 232 from switch 218 is sent directly to a power latch mechanism 236A to unlatch the door.

Referring to FIG. 8, the vehicle panel control system 210 of FIGS. 5 and 6 is shown as part of a mechanical latch system 231B, and may be used with either a manual or power door. The mechanical latch system 231B may be either manually activated by pulling on handle 214 with force F1 to cause movement in direction of arrow A as shown in FIG. 5, or electrically actuated by pushing on handle 214 with force F2 to cause movement in direction of arrow B as shown in FIG. 6. The mechanical latch system 231B includes a first cable 233A fixed at one end to the body 222 of handle 214, and connected through a slot 241 to a lever 237 fixed to the door such that it is pivotable about point P. A second cable 233B is fixed at one end to the lever 237 and at another end to a mechanical latch 236B operable to latch and unlatch the door (and thereby the panel 212) to the vehicle frame. When the latch system 231B is manually actuated, the force F1 applied to handle 214 (see FIG. 5) pulls on cable 233A and causes the lever 237 to rotate in the direction of arrow Q, also pulling on cable 233B and unlatching the latch 236B. When the latch system is electrically actuated, the force F2 applied to handle 214 (see FIG. 6) sends a signal 232B to electric motor 239, causing the motor 239 to rotate lever 237 in direction of arrow Q, pulling on cable 233B and unlatching latch 236B. Cable 233A may not become taught when motor 239 rotates lever 237, as it is of a sufficient length to have play that allows it to "float" within the slot 241.

Figure 9:
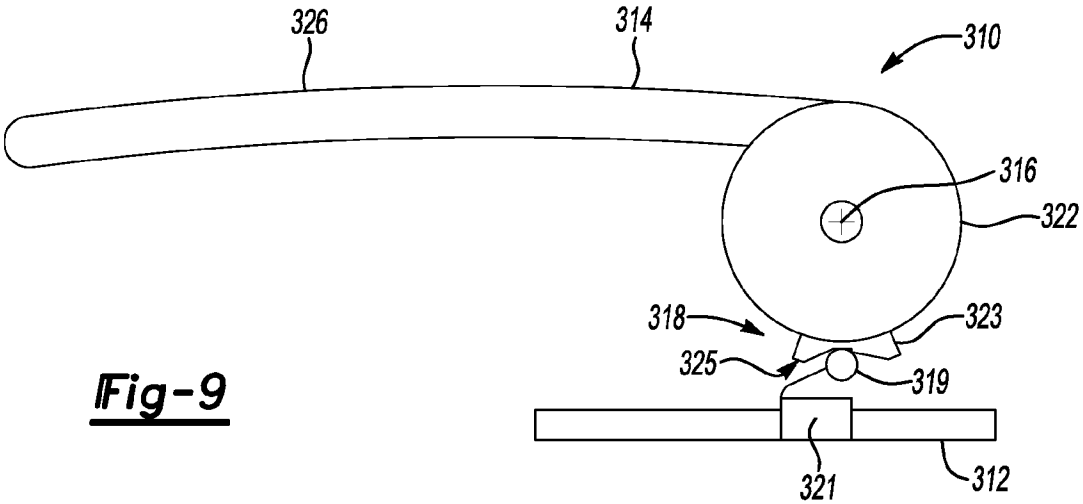
FIG. 9 is a schematic fragmentary top view of a fourth embodiment of a vehicle panel control system including a handle in a neutral position and a switch in an open position.
Figure 11:
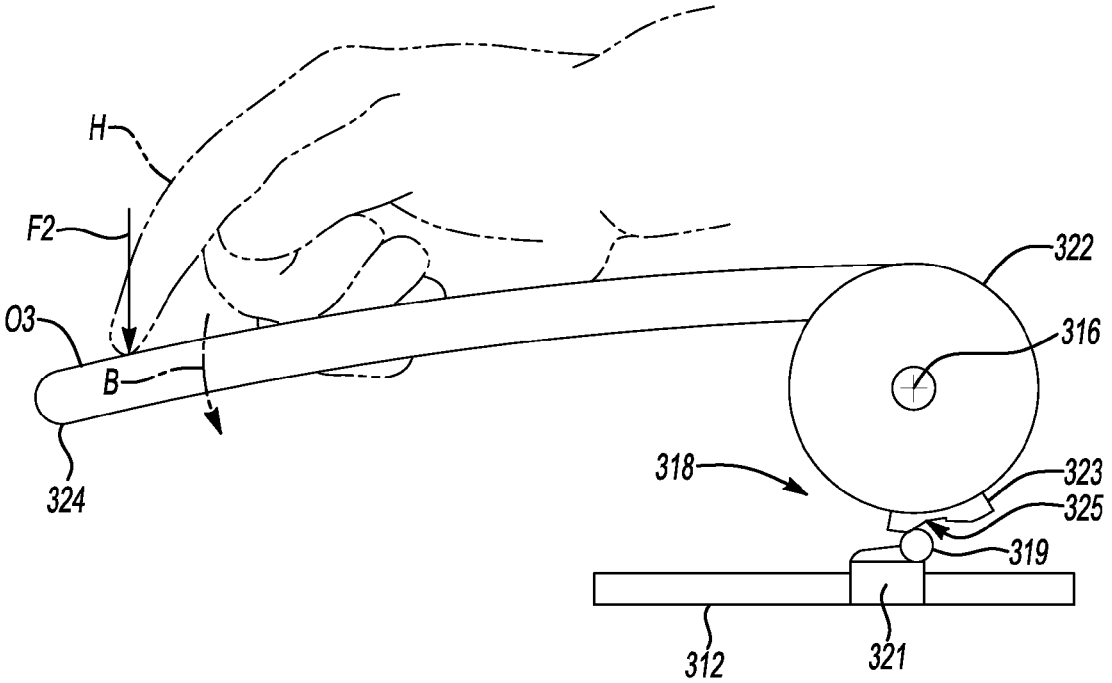
FIG. 11 is a schematic top view of the vehicle panel control system of FIG. 9, with the handle pivoted in a second direction by the hand shown in phantom so that the switch is in a closed position.

Referring to FIGS. 9-11, an alternate embodiment of a vehicle panel control system 310 is shown that utilizes a handle-mounted switch 318. In this alternate construction, a door handle 314 is pivotable about pivot point 316 in direction of arrow A by applying force F1 to inner side I3 of handle 314 near end 324 of lever 326 to cause power movement or unlatching of the door to which trim panel 312 is a part or to cause power movement of another panel. A switch 318 is mounted to the pivot body 322 of the handle 314, relatively near the pivot axis 316 of handle 314, rather than near the end 324 of lever 326. The switch 318 is open when the handle 314 is in the neutral position shown in FIG. 9. When the switch 318 is open, contact element 319 is not in contact with switch body 321, and the switch 318 is not operable to move or unlatch the panel 312 or another panel. A cam 323 on the handle body 322 is configured with a cam surface 325 that positions the contact element 319 away from the switch body 321 when the switch 318 is open in FIG. 9.

When the handle 314 is manually pushed in the direction A as shown in FIG. 10, using a fingertip push of force F1 on inner surface I3 of the handle 314, the cam 323 rotates with the handle 314 so that the cam surface 325 causes the contact element 319 to move into contact with the switch body 321, closing the switch 318 causing power movement of panel 312 or of another panel or electronic lock release (unlatching) of the panel 312.

Referring to FIG. 11, when the handle 314 is moved in direction of rotation B by applying force F2 to outer side O3 of handle 314, utilizing available over-travel motion, the cam 323 rotates with the handle 314 so that the cam surface 325 causes the contact element 319 to move into contact with the switch body 321, closing the switch 318, thereby causing power movement of panel 312 or of another panel or electronic lock release (unlatching) of the panel 312.

While the best modes for carrying out the invention have been described in detail, those familiar with the art to which this invention relates will recognize various alternative designs and embodiments for practicing the invention within the scope of the appended claims.

The invention claimed is:

1. A vehicle panel control system for a vehicle that has a latch mechanism, comprising:

a vehicle panel that includes an extension;

a handle that includes a pivot body pivotably connected to the vehicle panel and movable about a pivot point in a first direction to mechanically unlatch the latch mechanism from the panel;

a switch positioned to be closed when the handle is sufficiently moved in a second direction opposite the first direction, closure of the switch operable to electronically unlatch the latch mechanism from the panel, unlatching of the latch mechanism from the panel thereby being accomplished by either of two different motions; and wherein the switch includes a switch body mounted to the pivot body and a contact element so that when the handle is sufficiently moved in the second direction, the switch body is pivoted to engage the extension on the panel to contact the contact element, thereby closing the switch and causing the electronic unlatching of the latch mechanism.

2. The vehicle panel control system of claim 1, wherein the pivot body is concentric about the pivot point; and wherein the handle has a lever extending from the switch body; and wherein force is applied to the lever to move the handle about the pivot point.

3. The vehicle panel control system of claim 1, wherein the latch mechanism includes a pivotable lever, a mechanical latch, a first cable connecting the pivot body to the pivotable lever, and a second cable connecting the pivotable lever to the mechanical latch; and wherein movement of the handle in the first direction causes the handle to pull on the first cable, and thereby pivot the pivotable lever and pull on the second cable to unlatch the mechanical latch.

4. The vehicle panel control system of claim 1, wherein the latch mechanism includes a pivotable lever, a mechanical latch, a first cable connecting the pivot body to the pivotable lever, a second cable connecting the pivotable lever to the mechanical latch, and an electric motor operatively connected to the pivotable lever and to the switch; and wherein movement of the handle in the second direction to close the switch provides a signal from the switch to the electric motor to pivot the pivotable lever, thereby pulling on the second cable to unlatch the mechanical latch.

5. A vehicle panel control system for a vehicle that has a latch mechanism, comprising:

a vehicle panel that includes an extension;

a handle that includes a pivot body pivotably connected to the vehicle panel and having an inner side facing the vehicle panel and an outer side facing away from the vehicle panel; wherein the panel is configured to be movable about a pivot point in a first direction by applying force to the inner side to mechanically unlatch the latch mechanism from the panel;

a switch positioned to be closed when the handle is sufficiently moved in a second direction opposite the first direction by applying force to the outer side, closure of the switch operable to electronically unlatch the latch mechanism from the panel, unlatching of the latch mechanism from the panel thereby being accomplished by either of two different motions; and wherein the switch includes a switch body mounted to the pivot body and a contact element so that when the handle is sufficiently moved in the second direction, the switch body is pivoted to engage the extension on the panel to contact the contact element, thereby closing the switch and causing the electronic unlatching of the latch mechanism.

6. The vehicle panel control system of claim 5, wherein the force applied to the inner side is a pulling force and the force applied to the outer side is a pushing force.

7. The vehicle panel control system of claim 5, wherein the latch mechanism includes a pivotable lever, a mechanical latch, a first cable connecting the pivot body to the pivotable lever, and a second cable connecting the pivotable lever to the mechanical latch; and wherein movement of the handle in the first direction causes the handle to pull on the first cable, and thereby pivot the pivotable lever and pull on the second cable to unlatch the mechanical latch.

8. The vehicle panel control system of claim 5, wherein the latch mechanism includes a pivotable lever, a mechanical latch, a first cable connecting the pivot body to the pivotable lever, a second cable connecting the pivotable lever to the mechanical latch, and an electric motor operatively connected to the pivotable lever and to the switch; and wherein movement of the handle in the second direction to close the switch provides a signal from the switch to the electric motor to pivot the pivotable lever, thereby pulling on the second cable to unlatch the mechanical latch.

9. A vehicle panel control system for a vehicle that has a latch mechanism comprising:

a vehicle panel that includes an extension;

a handle that includes a pivot body pivotably connected to the vehicle panel;

a switch operatively connected to the handle; wherein the handle is configured to cause mechanical unlatching of the latch mechanism from the panel when the handle is pivoted in a first direction away from the panel; wherein the handle is configured to cause electronic unlatching of the latch mechanism from the panel by closing the switch when the handle is pivoted in the second direction toward the panel; and wherein the switch includes a switch body mounted to the pivot body and a contact element so that when the handle is sufficiently moved in the second direction, the switch body is pivoted to engage the extension on the panel to contact the contact element, thereby closing the switch and causing the electronic unlatching of the latch mechanism.

10. The vehicle panel control system of claim 9, wherein the latch mechanism includes a pivotable lever, a mechanical latch, a first cable connecting the pivot body to the pivotable lever, and a second cable connecting the pivotable lever to the mechanical latch; and wherein movement of the handle in the first direction causes the handle to pull on the first cable, and thereby pivot the pivotable lever and pull on the second cable to unlatch the mechanical latch.

11. The vehicle panel control system of claim 9, wherein the latch mechanism includes a pivotable lever, a mechanical latch, a first cable connecting the pivot body to the pivotable lever, a second cable connecting the pivotable lever to the mechanical latch, and an electric motor operatively connected to the pivotable lever and to the switch; and wherein movement of the handle in the second direction to close the switch provides a signal from the switch to the electric motor to pivot the pivotable lever, thereby pulling on the second cable to unlatch the mechanical latch.

* * * * *